US009331401B2

(12) United States Patent
Pineda et al.

(10) Patent No.: US 9,331,401 B2
(45) Date of Patent: May 3, 2016

(54) MULTI-TAP PIERCING CONNECTOR

(71) Applicant: Hubbell Incorporated, Shelton, CT (US)

(72) Inventors: Alejandro Pineda, Bosques de Metepec (MX); Rodolfo Magaña, Bosques de Metepec (MX)

(73) Assignee: Hubbell Incorporated, Shelton, CT (US)

( * ) Notice: Subject to any disclaimer, the term of this patent is extended or adjusted under 35 U.S.C. 154(b) by 151 days.

(21) Appl. No.: 14/178,748

(22) Filed: Feb. 12, 2014

(65) Prior Publication Data

US 2015/0229040 A1 Aug. 13, 2015

(51) Int. Cl.
*H01R 4/24* (2006.01)
*H01R 9/24* (2006.01)

(52) U.S. Cl.
CPC ..... *H01R 4/2408* (2013.01); *H01R 9/24* (2013.01)

(58) Field of Classification Search
CPC ..... H01R 4/2404; H01R 4/2408
See application file for complete search history.

(56) References Cited

U.S. PATENT DOCUMENTS 4,153,326 A * 5/1979 Frantz ..... H01R 13/28 439/293
4,427,253 A 1/1984 Smith et al.
5,007,855 A 4/1991 O'Brien et al.
5,044,978 A * 9/1991 Gelin ..... H01R 9/0509 439/394
5,080,606 A * 1/1992 Burkard ..... H01R 4/2454 439/402
5,484,304 A * 1/1996 Capper ..... H01R 4/2441 439/409
5,533,912 A * 7/1996 Fillinger ..... H01R 13/5213 439/521
5,713,748 A 2/1998 Mulvihill
6,074,238 A * 6/2000 DeRoss ..... H01R 12/675 439/409
6,080,006 A * 6/2000 Broder ..... H01R 4/2433 439/409
6,086,406 A 7/2000 Francois et al.
6,302,723 B1 * 10/2001 Baum ..... H01C 7/12 439/412
6,517,391 B1 2/2003 Chadbourne
7,094,094 B2 8/2006 Zahnen et al.
7,104,832 B2 9/2006 Campbell et al.
7,789,695 B2 * 9/2010 Radle ..... H01R 4/2433 439/402
8,025,524 B2 9/2011 Temblador et al.
8,444,431 B1 5/2013 La Salvia
8,568,157 B2 10/2013 Bishop
2011/0318953 A1 12/2011 Battle
2013/0005175 A1 1/2013 Rineau et al.
2013/0183874 A1 7/2013 Cawood et al.

OTHER PUBLICATIONS

PCT/US2015/13744 International Search Report and Written Opinion dated Aug. 28, 2015.

* cited by examiner

*Primary Examiner* — Briggitte R Hammond
(74) *Attorney, Agent, or Firm* — Michael Best & Friedrich, LLP

(57) ABSTRACT

A piercing connector includes a connector body, a piercing insert, and a piercing cover. The connector body has a plurality of conductor apertures and a piercing aperture. The piercing insert has a plurality of piercing teeth and is inserted into the piercing aperture. The piercing cover is inserted into the piercing aperture and removably attached to the connector body. The piercing cover removably secures the piercing insert in the connector body. The piercing connector receives and electrically connects two or more conductors.

18 Claims, 11 Drawing Sheets

MULTI-TAP PIERCING CONNECTOR

FIELD OF THE INVENTION

The present invention relates to electrical piercing connectors.

BACKGROUND OF THE INVENTION

Electrical connectors are used to connect two or more electrical conductors in a variety of environments. Connectors may be used to transfer power from main conductors to secondary tap conductors. The main power conductors and the tap conductors may have different sizes, requiring specially designed connectors for each connection between the conductors through the teeth.

One type of electrical connector is a piercing connector. Piercing connectors typically have opposite halves with two mating grooves to retain a pair of conductors. The grooves are typically sized for specific sized conductors. The opposite halves have one or more sets of insulation piercing teeth. When the conductors are placed in the grooves and the two halves of the connector are placed together, the teeth pierce the insulation of the conductors and contact the conductor strands, providing an electrical connection.

SUMMARY OF THE INVENTION

In accordance with an embodiment, a piercing connector includes a connector body, a piercing insert, and a piercing cover. The connector body has a plurality of conductor apertures and a piercing aperture. The piercing insert has a plurality of piercing teeth and is inserted into the piercing aperture. The piercing cover is inserted into the piercing aperture and removably attached to the connector body. The piercing cover removably secures the piercing insert in the connector body.

Preferably the a piercing connector includes a connector body, a piercing insert, and a piercing cover. The connector body has a plurality of conductor apertures, a piercing aperture, and a central cavity in communication with the plurality of conductor apertures and the piercing aperture.
The piercing insert has a plurality of sets of piercing teeth and is inserted into the piercing aperture and into the central cavity. The piercing cover is inserted into the piercing opening and attached to the connector body.

More preferably the piercing connector includes a connector body, a conductor sleeve, a set screw, a cap, a piercing insert, and a piercing cover. The connector body has a plurality of conductor apertures, a plurality of ports for receiving set screws, a piercing aperture, and a central cavity in communication with the plurality of apertures, the plurality of ports, and the piercing aperture. The conductor sleeves are positioned around each of the plurality of conductor apertures. The set screws are positioned in each of the plurality of ports and the caps are connected to each of the plurality of ports. The piercing insert has a plurality of sets of piercing teeth and is inserted into the piercing aperture and into the central cavity. The piercing cover is inserted into the piercing opening and attached to the connector body.

Other embodiments, including apparatus, systems, methods, and the like which constitute part of the invention, will become more apparent upon reading the following detailed description of the exemplary embodiments and viewing the drawings. It is to be understood that both the foregoing general description and the following detailed description are exemplary and explanatory only and therefore not restrictive.

BRIEF DESCRIPTION OF THE DRAWINGS

The accompanying drawings are incorporated in and constitute a part of the specification. In such drawings.

DETAILED DESCRIPTION OF EXEMPLARY EMBODIMENTS OF THE INVENTION

Figure 1:
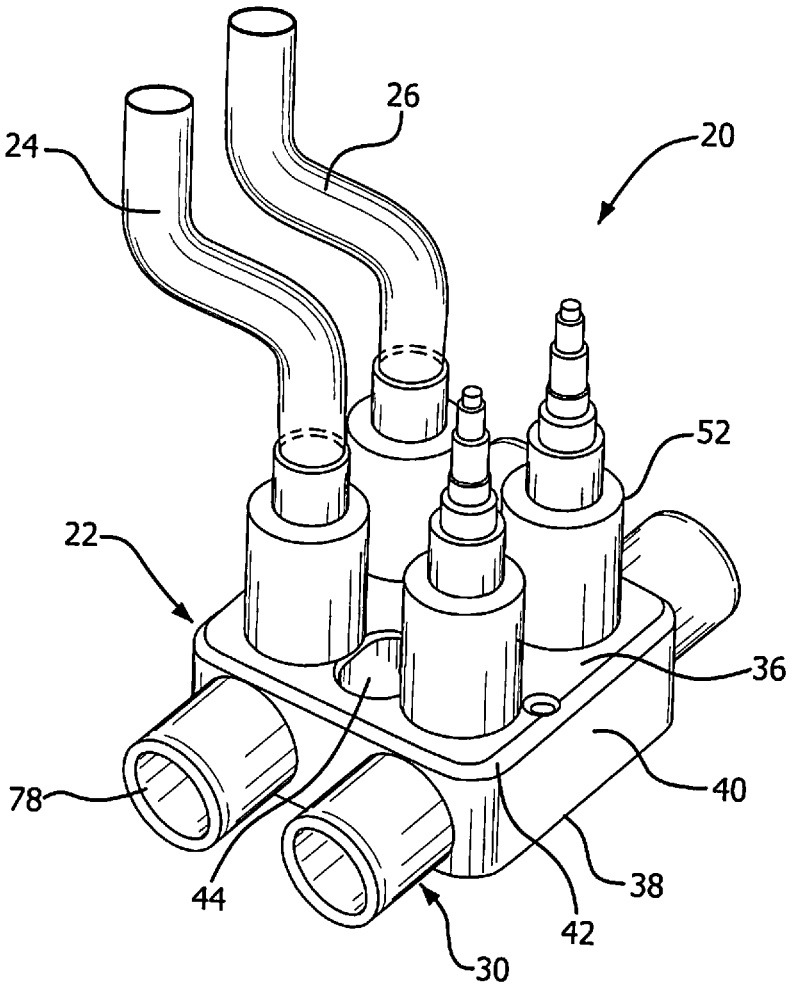
FIG. 1 is a perspective view of a piercing connector with a pair of conductors inserted according to an exemplary embodiment of the invention.

Reference will now be made in detail to the exemplary embodiments of the invention as illustrated in the accompanying drawings, in which like reference characters designate like or corresponding parts throughout the drawings.

A piercing connector 20 includes a connector body 22 for receiving a main conductor 24 and at least one tap conductor 26. The connector body 22 has a plurality of conductor apertures 28, a plurality of ports 30, a piercing insert 32, and a piercing cover 34. The piercing connector 20 is designed to provide a safe and durable electrical connection between multiple conductors, even in harsh environments. For example, the piercing connector 20 may be advantageously used in underground applications where water and debris or other contaminants are typical factors.

Figure 2:
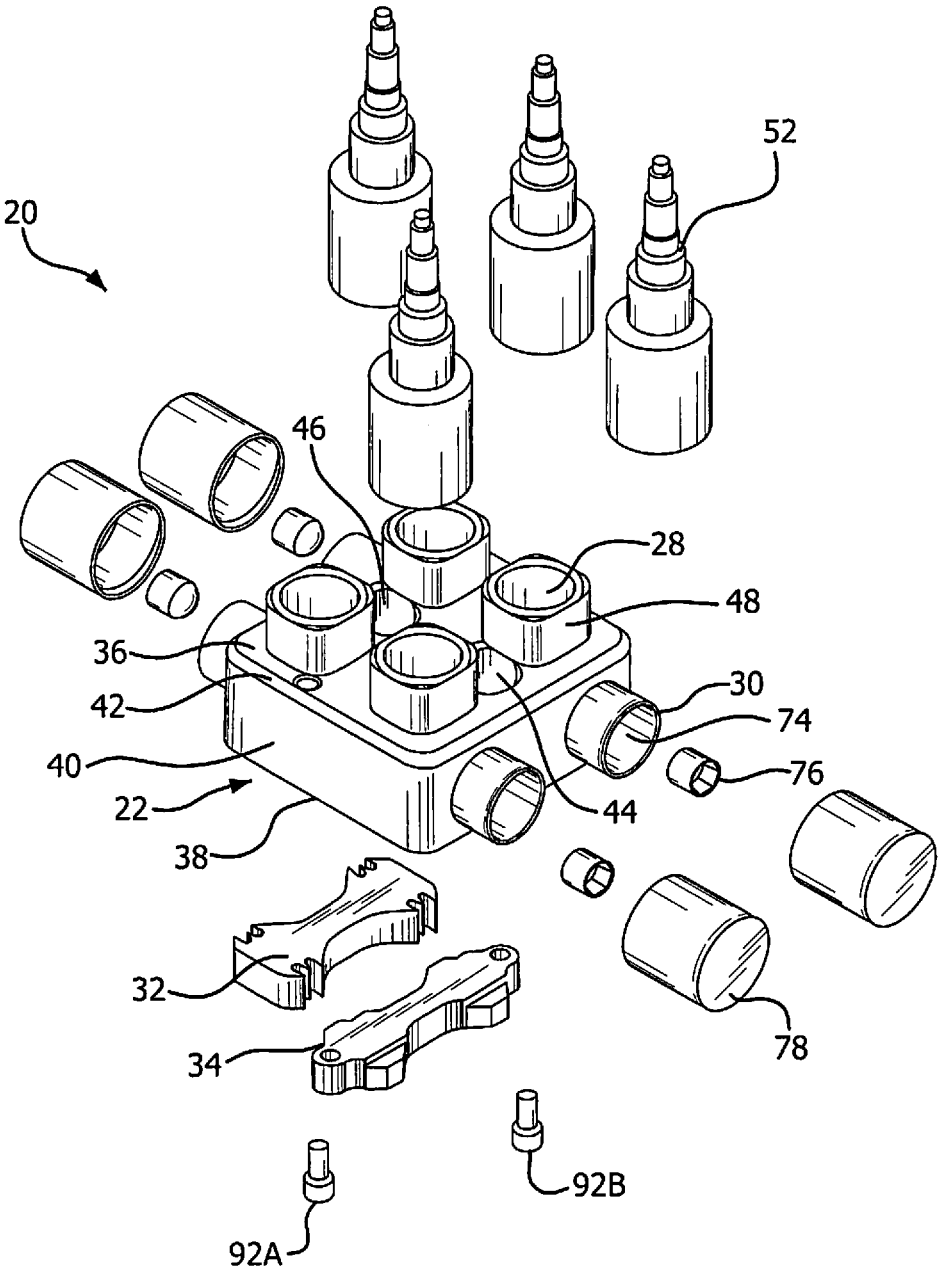
FIG. 2 is an exploded perspective view of the piercing connector of FIG. 1 with the conductors removed.
Figure 3:
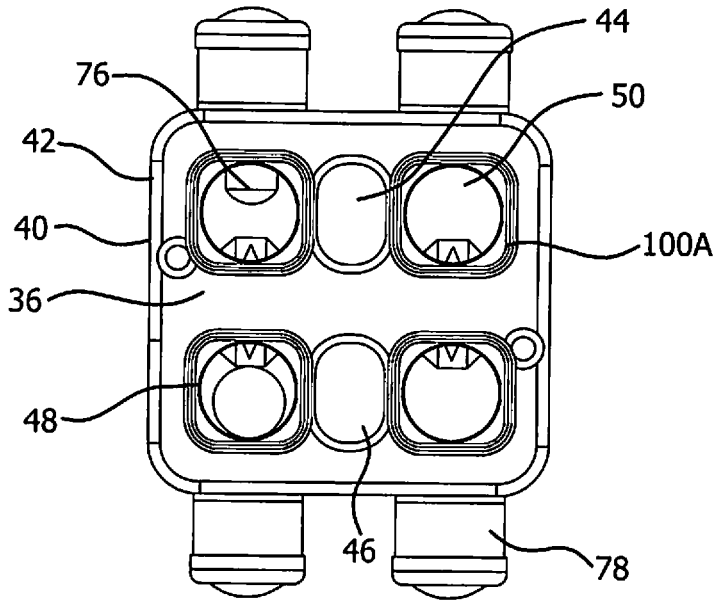
FIG. 3 is a top view of the piercing connector of FIG. 1 with the conductors and conductor sleeves removed.

As best shown in FIGS. 2 and 3, the connector body 22 includes four conductor apertures 28, four ports 30, and has a substantially cuboid shape with a rectangular cross-section. In various alternative embodiments, the size, shape, and configuration of the connector body 22 may vary depending on the number of conductors to be attached. For example, the connector body 22 may have a triangular shape to connect three conductors, a hexagonal shape to connect six conductors, an octagonal shape to connect eight conductors, etc. The connector block 22 may also retain a cuboid configuration and expand the length or width of the sides to accommodate additional conductors. Accordingly, certain aspects of the exemplary embodiment discussed herein may be duplicated or similar to one another depending on the layout and configuration of the piercing connector 20. In the interest of brevity, only a single iteration of a component may be described in the specification and labeled in the drawings.

The connector body 22 has a top surface 36, a bottom surface 38, and a plurality of side surfaces 40. A beveled edge 42 may connect the top surface 36 and bottom surface 38 with the plurality of side surfaces 40. The connector body 22 includes a first drain opening 44 and a second drain opening 46 extending therethrough. The drain openings 44, 46 help prevent water and debris from collecting or pooling on the connector body 22. The connector body 22 may be made from a durable, corrosive-resistant material such as aluminum or an aluminum alloy.

The conductor apertures 28 extends through the top surface 36 of the connector body 22. The conductor apertures 28 may be defined by a tubular member 48 extending outwardly from the top surface 36 of the connector body 22. The conductor apertures 28 and the tubular members 48 extend parallel to one another and are substantially perpendicular to the top surface 36. In various alternative embodiments, one or more of the conductor apertures 28 and tubular members 48 may be inclined with respect to the top surface 36. Four tubular members 48 are shown, although the number will vary dependent on the number of conductors needed in the application.

The tubular member 48 has a cylindrical inner wall for receiving a cylindrical conductor and an outer wall with a substantially rounded polygon shape in cross-section, for example a rounded square or rounded rectangle. In various alternative embodiments, the shape and size of the tubular member 48 may vary dependent on the environment and the type of conductor associated with the connector body 22. The tubular member 48 at least partially surrounds the conductor aperture 28, defining a passage into a central cavity 50.

As best shown in FIGS. 1 and 2, a conductor sleeve 52 at least partially encloses the conductor aperture 28. The conductor sleeve 52 extends outwardly from the tubular member 48 and may also extend around the tubular member 48. In various exemplary embodiments, the conductor sleeve 52 is pressed over the tubular member 48, forming a removable, interference fit attachment to the connector body 22. The conductor sleeve 52 may form a water-resistant or water-tight seal around the tubular member 48. The conductor sleeve 52 is preferably formed from a flexible material such as a flexible polymer or elastomeric material. The material may be chosen to resist high and/or low temperature applications and also to be corrosive resistant.

Figure 5:
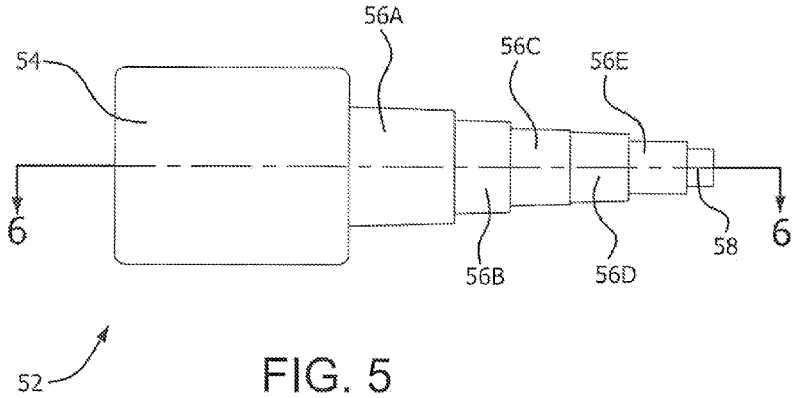
FIG. 5 is a side view of a conductor sleeve of FIG. 2.

As best shown in FIG. 5, the conductor sleeve 52 has an outer configuration composed of tiered cylinder sections starting with a base section 54, extending with intermediate sections 56, and ending with a tip section 58. In alternative embodiments, the shape of the conductor sleeve 52 may vary. The exemplary embodiment shows five intermediate cylindrical sections 56A-E, although any number may be used. The base section 54 has the largest outer diameter and the tip section 58 has the smallest outer diameter. As the sleeve extends from the base section 54 to the tip section 56, each subsequent intermediate section 56A-E decreases in inner and outer diameters. In alternative embodiments, one or more intermediate sections 56A-E may have an equal outer diameter. The base section 54 may have the greatest length, although the length of each section may vary.

Figure 6:
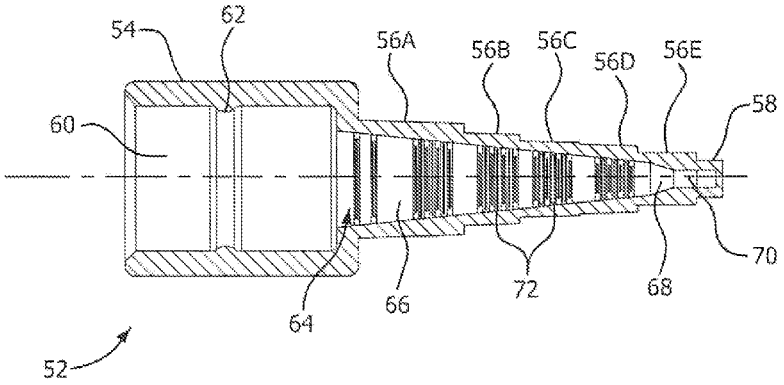
FIG. 6 is a side view in section of FIG. 5 taken along line 5-5.

As best shown in FIG. 6, the inner surface of the base section 54 defines a substantially first cylindrical opening 60. A protrusion 62 may extend from the inner surface of the base section 54 to assist in providing an interference fit with the tubular member 48. Extending from the first cylindrical opening 60 is an extension opening 64. The extension opening 64 may be tapered and may also include a first frusto-conical opening 66, a second frusto-conical opening 68 extending from the first frusto-conical opening 66, and a second cylindrical opening 70 extending from the second frusto-conical opening 68. The first and second frusto-conical openings 66, 68 are at least partially defined by the inner surfaces of the intermediate cylindrical sections 56A-E. The second cylindrical opening 70 is at least partially defined by the inner surface of the last intermediate cylindrical section 56E and the inner surface of the tip section 58. In various alternative embodiments, the size and shape of the inner surfaces of the conductor sleeve 52 may vary. The conductor sleeve 52 may also include one or more sections having corrugations 72. The corrugations 72 increase the flexibility of the conductor sleeve, allowing the conductor sleeve to bend with a conductor inserted therein. As best shown in FIG. 6, the corrugations 72 are placed in sets formed in the inner surfaces of the intermediate cylindrical sections 56A-D. In various alternative embodiments, the corrugations 72 may be formed in the outer surface or both the outer and inner surfaces and may also extend any length along the conductor sleeve 52. The number of corrugations 72 and their positions may also be varied to increase or decrease the flexibility of different points of the conductor sleeve 52.

The inner surface of the conductor sleeve 52 is designed to form a sealed engagement with a conductor, for example a water-resistant or water-tight seal. To achieve a proper sized opening relative to different sized conductors, the conductor sleeve 52 may be trimmed at the tip section 58, at any intersection of the intermediate cylindrical sections 56A-E, or at any portion along the intermediate cylindrical sections 56A-E. In various exemplary embodiments, the outer diameters of the conductor sleeve 52 sections may be used to determine the appropriate position to trim the conductor sleeve 52. For example, the tip 58 and intermediate sections 56A-E may be sized to correspond to various diameters of conductors that may be used with the connector body 22. A user may match a conductor with the corresponding section and trim the conductor sleeve 52 just above that section. The conductor may then be inserted through the conductor sleeve 52 and into the conductor aperture 28.

As best shown in FIG. 2, ports 30 extend from the side surface 40 of the connector body 22. The ports 30 are substantially perpendicular to the side surface 40. In various alternative embodiments, one or more of the ports 30 may be inclined with respect to the side surface 40. Four ports 30 are shown with two on one side surface 40 and two on an opposite side surface 40, although the number and location may vary dependent on the number of conductors needed in the application and the configuration of the connector body 22.

Each port 30 has a tubular shape with an outer wall and an inner wall defining a passage 74 through the side surface 40 and into the central cavity 50. In various alternative embodiments, the shape and size of the port 30 may vary dependent on the environment and the type of conductor associated with the connector body 22. The port 30 may include an inner thread (not shown) for receiving a set screw 76. The set screw 76 has an outer thread (not shown) corresponding to the inner thread of the port 30 and a head for receiving a driving tool, for example a hexagonal head. The opposite end of the set screw 76 includes a rounded surface for engaging a conductor. The set screw 76 may be adjusted by a user to retain a conductor inserted into the connector body 22. Instead of a set screw 76, other types of insertable or removable mechanical fasteners may be used.

Figure 7:
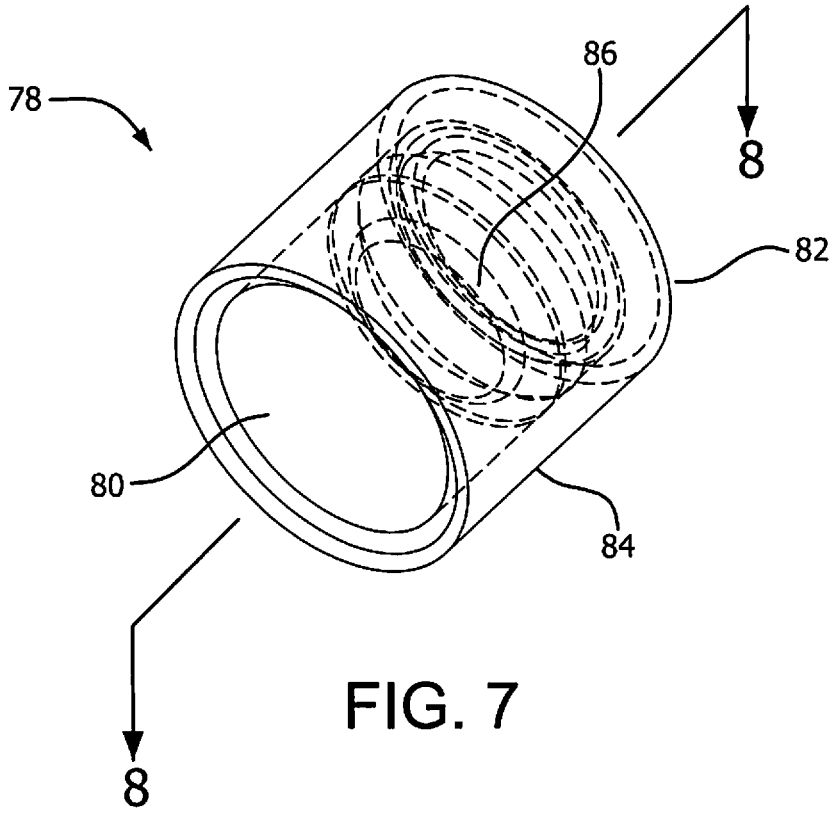
FIG. 7 is perspective view of a cap of FIG. 2.
Figure 8:
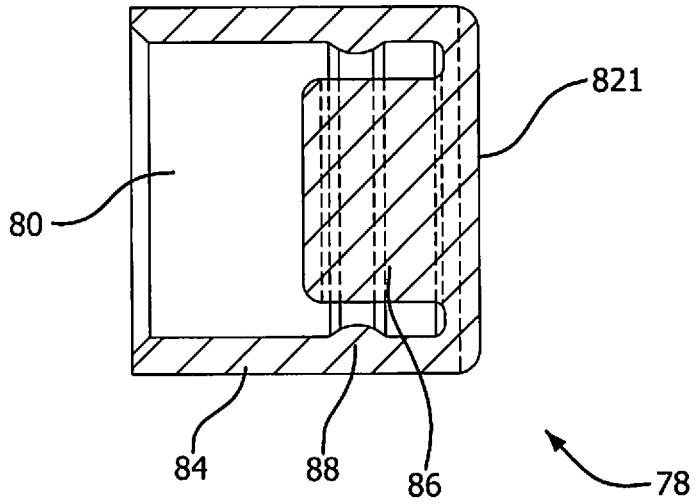
FIG. 8 is a side view in section of FIG. 7 taken along line 8-8.

A cap 78 may be placed over the port 30 to form a seal, for example a water-resistant or water-proof seal. The cap 78 is pressed over the port, forming a removable, interference-fit attachment to the connector body 33. As best shown in FIGS. 7 and 8, the cap 78 has a cap opening 80, a cap end wall 82, and a substantially tubular body 84. A plug 86 extends from the cap end wall 82 into the cap opening 80. The plug 86 may be designed to at least partially fit into the port 30, either through an interference fit or with a slight tolerance. A protrusion 88 may extend from the tubular body 84 into the opening to assist in retaining the cap 78 on the port 30 and for providing an additional sealing surface.

Figure 4:
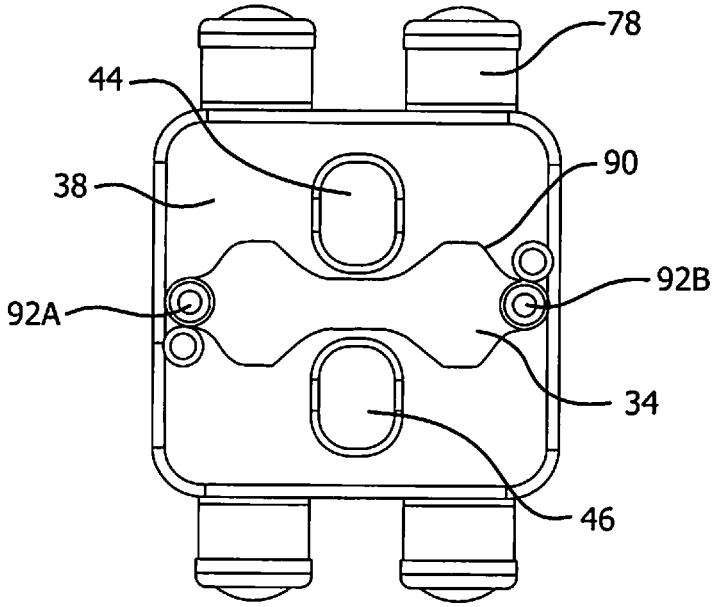
FIG. 4 is a bottom view of the piercing connector of FIG. 3.

As best shown in FIG. 4, the bottom surface 38 includes a piercing aperture 90. The piercing aperture 90 extends through the bottom surface 38 and is in communication with the central cavity 50. The piercing aperture 90 receives the piercing insert 32 and the piercing cover 34 and may be sized and shaped accordingly. As shown, the piercing aperture 90 has a substantially hourglass shape. A pair of threaded apertures (not shown) may be accessible through the piercing aperture 90 to receive mechanical fasteners 92A-B to attach the piercing cover 34, holding the piercing insert 32 in place.

Figure 9:
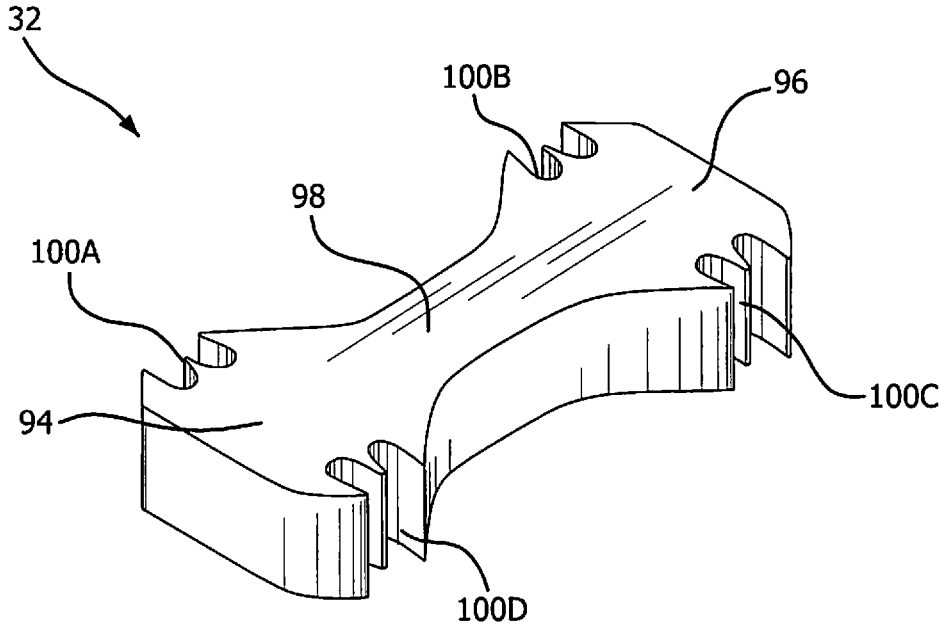
FIG. 9 is a perspective view of a piercing insert of FIG. 2.

As best shown in FIG. 9, the piercing insert 32 has a substantially bisymmetrical hourglass shape with a first head 94, a second head 96, and a central portion 98 connecting the first and second heads 94, 96. The piercing insert 32 includes four sets of teeth 100A-D, with a set extending from each side of the first head 94 and each side of the second head 96. Each set of teeth 100A-D includes three piercing teeth, although one or more piercing teeth may be used in various alternative embodiments. The piercing teeth 100A-D are designed to pierce the insulation of a conductor and contact the electrical conductive metal strands contained therein. The piercing insert 32 is made from an electrically conductive material so that an electrical connection may be formed between separate conductors through the piercing insert 32. Accordingly, the shape and configuration of the piercing insert 32 may vary depending on the configuration of the connector body 22 and the number of conductors.

Figure 10:
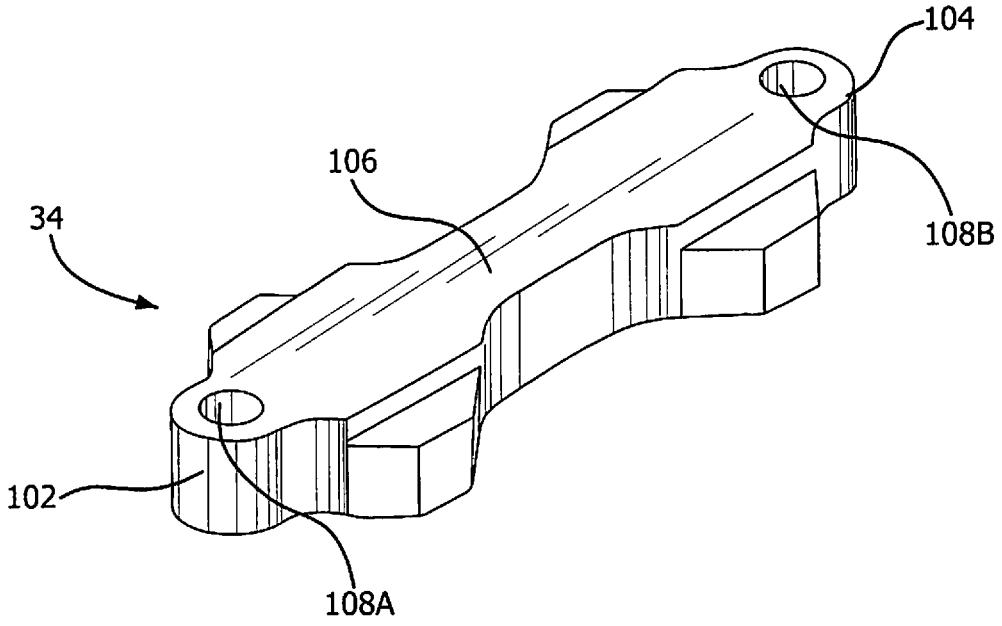
FIG. 10 is a perspective view of a piercing cover of FIG. 2.
Figure 11:
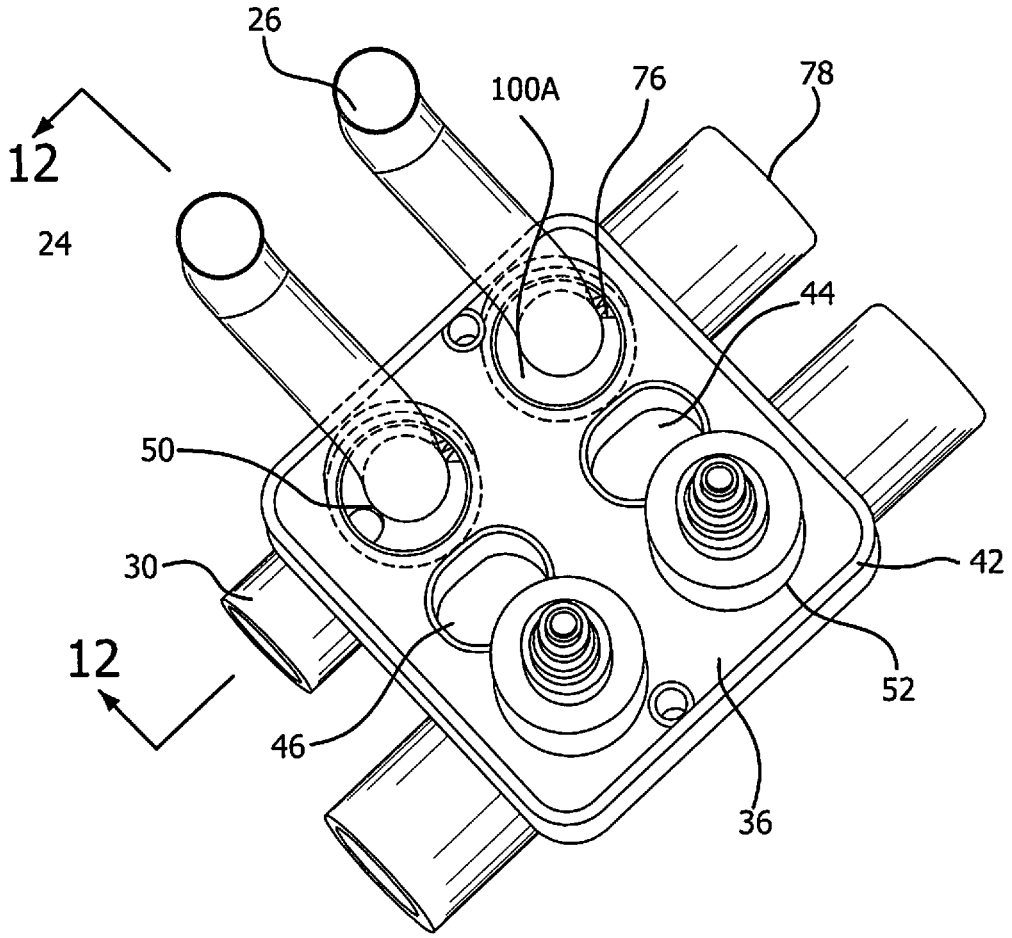
FIG. 11 is a top perspective view of the piercing connector of FIG. 1 with two conductors inserted and one port uncapped.
Figure 12:
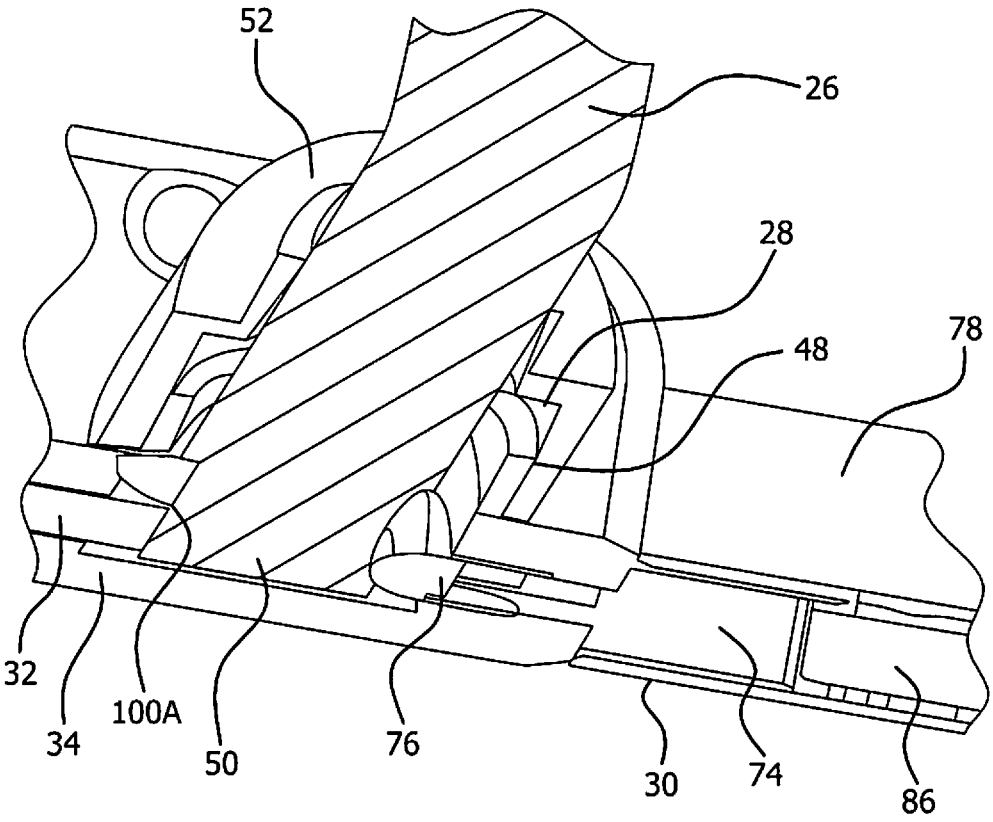
FIG. 12 is an enlarged perspective view in section of FIG. 11 taken along line 12-12.

As best shown in FIG. 10, the piercing cover 34 has a substantially bisymmetrical hourglass shape with a first head 102, a second head 104, and a central portion 106 connecting the first and second heads 102, 104. The middle of the piercing cover 34 is raised with respect to the outer head portions 102, 104 for contacting the piercing insert 32 and allowing space for the piercing teeth 100A-D to fully contact the conductor strands. The piercing cover 34 includes a first aperture 108A and a second aperture 108B for receiving mechanical fasteners 92A-B that extend through the first and second apertures 108A-B to attach the piercing cover 34 to the connector body 22. The mechanical fasteners 92A-B may be threaded fastener having outer threads. In various alternative embodiments, the piercing cover 34 may include one aperture or more than two apertures for receiving mechanical fasteners. The piercing cover 34 may be made from a rigid or stiff elastomeric material such as EPDM rubber, which provides sufficient stability to support the piercing insert 32 but also is capable of sealing the piercing aperture 90. The piercing cover 34 may also be made from a material including metal or polymers.

Figure 13:
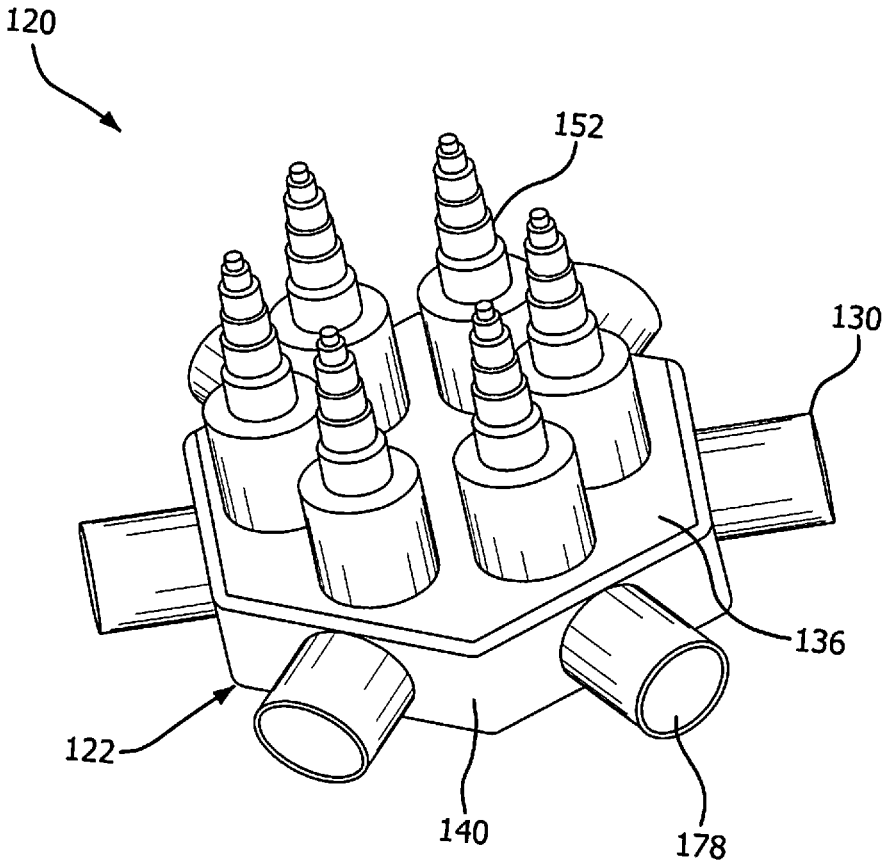
FIG. 13 is a perspective view of a piercing connector according to a second exemplary embodiment of the invention.
Figure 14:
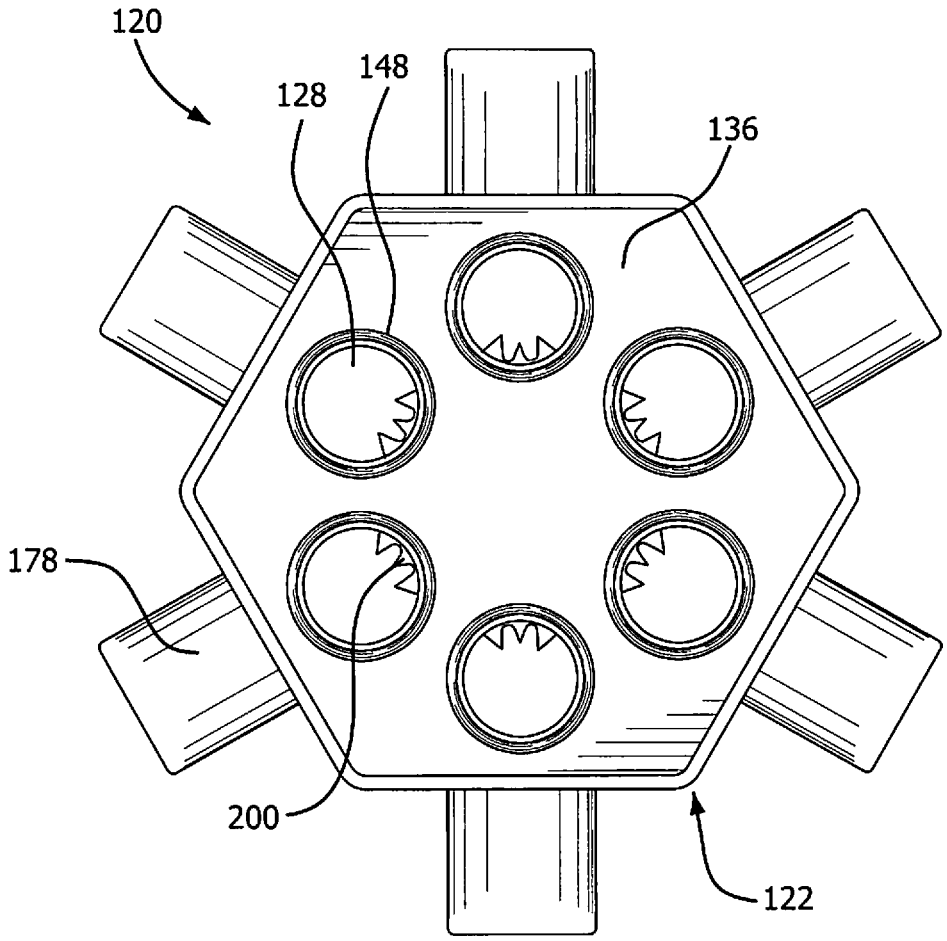
FIG. 14 is a top view of the piercing connector of FIG. 13.
Figure 15:
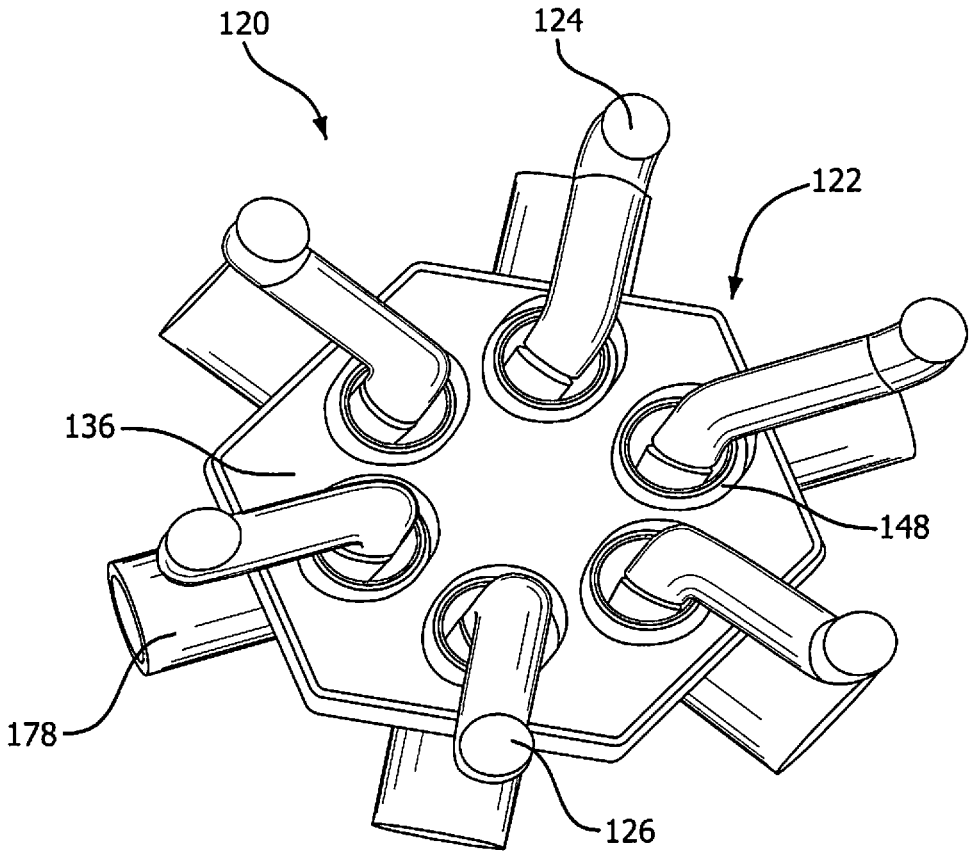
FIG. 15 is a perspective view of the piercing connector of FIG. 13 with inserted conductors and without the conductor sleeves.

FIGS. 13-15 depict an alternative exemplary embodiment of a piercing connector 120. The piercing connector 120 has a connector body 122 with a hexagonal block shape. The piercing connector 120 shown in FIGS. 13-15 may utilize the same components as the piercing connector 20 as shown in FIGS. 1-12 and described herein, but modified to accommodate the additional conductors. For example, the connector body 122 has a top surface 136 and a six side surfaces 140. Six conductor apertures 128 defined by tubular members 148 extending from the top surface 136. A conductor sleeve 152 may be associated with each conductor aperture 128. Six ports 130 extend from the side surfaces 140. Each port 130 may have a cap 178 for sealing the port 130. A six-sided piercing insert 132 having six sets of piercing teeth 200 is used to connect a main conductor 124 with five tap conductors 126. The piercing insert may be placed into the connector body via a substantially hexagon-shaped piercing aperture (not shown). The piercing insert 132 may be held in place by an appropriately sized and shaped piercing cover (not shown).

In operation, the piercing connector 20 is used to electrically connect a main conductor 24 with one or more tap conductors 26. A user determines the size of the conductors 24, 26 and matches that size to a corresponding section of the conductor sleeve 52. The main and tap conductors 24, 26 may be the same size or different sizes. The conductor sleeve 52 is trimmed at the appropriate point to form an opening for receiving the appropriate conductor. The main and tap conductors 24, 26 are then feed through the conductor sleeves 52 and through the conductor apertures 28 until the ends of the main and tap conductors 24, 26 are in the central cavity 50. The conductor sleeves 52 create a flexible, sealed connection with the conductors 24, 26, helping to prevent water or debris from entering the connector body 22. If any of the conductor apertures 28 are not being utilized, the conductor sleeves 52 may be left intact over the openings or another type of cap or seal may be utilized.

After the conductors 24, 26 have been inserted into the connector body 22, the user may tighten the appropriate set screws 76. The set screws 76 are rotated in the port 30 to engage the conductors 24, 26 and hold them in place. The ports 30 may be initially covered by the caps 78, or a user may place the caps 78 over the ports 30 after tightening the set screws 76. The caps 78 seal the ports 30 to prevent water or debris from entering the connector body 22.

After the conductors 24, 26 are retained in the central cavity 50, the user may then use the piercing insert 32 to electrically connect the main and tap conductors 24, 26. The piercing insert 32 and piercing cover 34 may be positioned in the connector body 22 or they may be inserted through the piercing aperture 90 by the user. The mechanical fasteners 92A-B extend through the piercing cover 34 and into respective threaded apertures in the connector body 22. The mechanical fasteners 92A-B are tightened, drawing the piercing cover 34 into the connector body 32, and in turn the piercing insert 32 into the central cavity 50. As the piercing insert 32 enters the central cavity 50, the piercing teeth 100 engage the conductors 24, 26, cutting through the insulation and contacting the conductor strands. The piercing insert 32 makes a connection with each of the inserted conductors 24, 26 simultaneously or substantially simultaneously, providing an electrical connection from the main conductor 24 to the tap conductors 26.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

What is claimed:

1. A piercing connector comprising:

a connector body having a top surface, a bottom surface, a plurality of conductor apertures, and a piercing aperture, said conductor apertures positioned in said top surface and said piercing aperture positioned in said bottom surface;

a piercing insert inserted into said piercing aperture and having a plurality of piercing teeth; and a piercing cover inserted into said piercing aperture and removably attached to said connector body to removably secure said piercing insert in said connector body, wherein said piercing insert and said piercing cover are movable in said piercing aperture towards said top surface.

2. The piercing connector of claim 1 wherein said piercing teeth at least partially align in a parallel orientation with said conductor apertures when said piercing insert is secured by said piercing cover.

3. The piercing connector of claim 1 wherein a conductor sleeve is positioned adjacent said conductor aperture.

4. The piercing connector of claim 1 wherein said connector body further comprises a plurality of ports each receiving a set screw to retain a conductor.

5. The piercing connector of claim 4 wherein said plurality of ports are orthogonal to said plurality of conductor apertures.

6. The piercing connector of claim 1 wherein said plurality of conductor apertures include four conductor apertures.

7. The piercing connector of claim 1 wherein said piercing cover is attached to said connector body by a mechanical fastener.

8. The piercing connector of claim 1 wherein a drain opening extends through said connector body.

9. A piercing connector kit comprising a connector body having a plurality of conductor apertures, a piercing aperture, a central cavity in communication with said plurality of conductor apertures and said piercing aperture, and a plurality of ports each receiving a set screw capable of extending into said central cavity to retain a conductor;

a piercing insert having a plurality of sets of piercing teeth and insertable into said piercing aperture and into said central cavity; and a piercing cover insertable into said piercing opening and attached to said connector body.

10. The piercing connector of claim 9 wherein an insulated conductor extends through at least one of said plurality of conductor apertures and into said central cavity.

11. The piercing connector of claim 10 wherein said set screw contacts said insulated conductor at a first position and at least one set of said plurality of sets of piercing teeth are aligned to pierce said insulated conductor at a second position.

12. The piercing connector of claim 11 wherein a mechanical fastener attaches said piercing cover to said connector body and wherein tightening of said mechanical fastener causes said piercing insert to contact said insulated conductor.

13. A piercing connector comprising a connector body having a plurality of conductor apertures, a plurality of ports for receiving set screws, a piercing aperture, and a central cavity in communication with said plurality of apertures, said plurality of ports, and said piercing aperture;

a conductor sleeve positioned around each of said plurality of conductor apertures;

a set screw positioned in each of said plurality of ports;

a cap connected to each of said plurality of ports;

a piercing insert, having a plurality of sets of piercing teeth, inserted into said piercing aperture; and a piercing cover inserted into said piercing opening and attached to said connector body.

14. The piercing connector of claim 13 wherein said connector body comprises a top surface, a bottom surface, and a plurality of side surfaces, and said plurality of conductor apertures being at least partially defined by a plurality of tubular members extending from said top surface.

15. The piercing connector of claim 14 wherein said piercing aperture is positioned in said bottom surface and said piercing insert is movable away from said bottom surface into said central cavity.

16. The piercing connector of claim 14 wherein said conductor sleeve comprises a base section having a first outer diameter, a tip section having a second outer diameter smaller than said first outer diameter, and a plurality of intermediate sections.

17. The piercing connector of claim 16 wherein said conductor sleeve further comprises a tapered extension opening.

18. The piercing connector of claim 13 wherein said conductor sleeve comprises corrugations.

* * * * *